US009636811B2

(12) United States Patent
Segura

(10) Patent No.: US 9,636,811 B2
(45) Date of Patent: May 2, 2017

(54) ACTUATION LOCKOUT FOR A FASTENER-DRIVING TOOL

(71) Applicant: Illinois Tool Works Inc., Glenview, IL (US)

(72) Inventor: Ricardo Segura, Lake in the Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 655 days.

(21) Appl. No.: 13/792,783

(22) Filed: Mar. 11, 2013

(65) Prior Publication Data

US 2014/0252060 A1 Sep. 11, 2014

(51) Int. Cl.
*B25C 1/00* (2006.01)

(52) U.S. Cl.
CPC ..... *B25C 1/008* (2013.01)

(58) Field of Classification Search
CPC ..... B25C 1/043; B25C 1/046
See application file for complete search history.

(56) References Cited

U.S. PATENT DOCUMENTS 3,543,987 A * 12/1970 Obergfell ..... B25C 1/003 227/136
3,638,532 A 2/1972 Novak
4,784,308 A * 11/1988 Novak ..... B25C 1/003 227/120
5,167,359 A * 12/1992 Frommelt ..... B25C 1/188 227/8
5,240,161 A * 8/1993 Kaneko ..... B25C 1/003 227/109
5,626,274 A * 5/1997 Shkolnikov ..... B25C 1/005 227/109
5,683,024 A 11/1997 Eminger et al.
5,829,661 A * 11/1998 Hirtl ..... B25C 1/184 227/10
6,170,730 B1 * 1/2001 Lin ..... B25C 1/003 227/119

(Continued)

FOREIGN PATENT DOCUMENTS

EP 1 693 160 A1 8/2006
EP 1 862 262 B1 12/2009

*Primary Examiner* — Hemant M Desai
*Assistant Examiner* — Tanzim Imam
(74) *Attorney, Agent, or Firm* — Neal, Gerber & Eisenberg LLP

(57) ABSTRACT

A fastener-driving tool including a housing, a power source including a reciprocating driver blade, a tool nose configured for receiving the driver blade for driving fasteners fed into the nose and a magazine configured to house a collation including a plurality of the fasteners. A workpiece contact element is movably connected to the nose and moves between a rest position and an actuated position when the workpiece contact element is pressed against a workpiece, the workpiece contact element moves to the actuated position. A lockout mechanism is operatively associated with the workpiece contact element and the magazine, and is in contact with the collation in a first position when fasteners are in the magazine and moves to a second position when a last fastener in the collation has been driven by the driver blade to block the workpiece contact element and prevent further actuation of the tool.

17 Claims, 15 Drawing Sheets

(56) References Cited

U.S. PATENT DOCUMENTS

| | | | | |
|---|---|---|---|---|
| 6,308,880 | B1 * | 10/2001 | Ronconi | B25C 1/003 227/119 |
| 6,371,348 | B1 | 4/2002 | Canlas et al. | |
| D501,383 | S | 2/2005 | Fang et al. | |
| 6,966,476 | B2 * | 11/2005 | Jalbert | B25C 1/003 227/137 |
| 6,994,240 | B2 * | 2/2006 | Jakob | B25C 1/184 227/10 |
| 7,416,100 | B2 * | 8/2008 | Fielitz | B25C 1/184 227/10 |
| 8,011,548 | B2 * | 9/2011 | Chang | B25C 1/008 227/125 |
| 8,276,798 | B2 | 10/2012 | Moeller et al. | |
| 2009/0039134 | A1 * | 2/2009 | Kubo | B25C 1/008 227/120 |
| 2009/0314818 | A1 * | 12/2009 | Segura | B25C 1/008 227/8 |
| 2012/0223120 | A1 | 9/2012 | Mina | |

* cited by examiner

ACTUATION LOCKOUT FOR A FASTENER-DRIVING TOOL

BACKGROUND

The present disclosure relates generally to powered, fastener-driving tools, wherein the tools may be electrically powered, pneumatically powered, combustion powered, or powder activated, and more particularly to a lockout mechanism for a fastener-driving tool that prevents actuation of the tool when there are no fasteners remaining in a collation in the tool magazine.

Powered, fastener-driving tools, of the type used to drive various fasteners, such as, for example, staples, nails, and the like, typically include a housing, a power source, a supply of fasteners held in a collation, a trigger mechanism for initiating the actuation of the tool, and a workpiece-contact element (also referred to herein as a "workpiece contacting-element" or "WCE"). The workpiece-contact element is configured for engaging or contacting a workpiece, and is operatively connected to the trigger mechanism. When the workpiece-contacting element is in contact with the workpiece, and depressed or moved inwardly a predetermined amount with respect to the tool housing, as a result of the tool being pressed against or moved toward the workpiece a predetermined amount, the trigger mechanism will be enabled to initiate fastener driving. Upon actuation of the tool, a piston including a driver blade is driven through a cylinder in the housing and into a drive channel loaded with a fastener. The driver blade contacts and drives the fastener into the workpiece.

Many fastener-driving tools include depth of drive adjustment mechanisms that adjust the depth in which the fasteners are driven into the workpiece. For example, fasteners may be driven into a workpiece so that the heads of the fasteners are flush with the outer surface of the workpiece. Alternatively, the depth of drive mechanism is adjustable so that the fasteners are recessed or driven to a designated distance in the workpiece and the heads of the fasteners are a designated distance below the outer surface of the workpiece. Recessing the fasteners is preferred in some circumstances, such as when attaching drywall to wood studs or other supports, so that the fastener heads can be covered and hidden with a drywall patching or joint compound, or other suitable setting compound.

On a job site, it is often difficult to tell when the fastener magazine is empty or near empty. Typically, a user finds out that the tool magazine is empty when the tool is "dry fired," i.e., actuated without a fastener loaded in the fastener drive channel. This is particularly a problem when attaching drywall, because the driver blade extends outwardly from the end of the workpiece contact element to recess the fasteners in the drywall, and thereby makes a mark or hole in the drywall when the tool is dry-fired. As a result, extra time and materials are needed to repair the inadvertent holes and damage to the drywall.

Accordingly, there is a need for a fastener-driving tool designed to prevent actuation of the tool when there are no fasteners remaining in the magazine.

SUMMARY

The present invention relates generally to powered, fastener-driving tools, wherein the tools may be electrically powered, pneumatically powered, combustion powered, or powder activated, and more particularly to an actuation lockout mechanism for a fastener-driving tool that prevents actuation of the tool when there are no fasteners remaining in the tool magazine.

In an embodiment, a fastener-driving tool is provided where the tool includes a housing, a power source associated with the housing and including a reciprocating driver blade, a tool nose connected to the housing and configured for receiving the driver blade for driving fasteners fed into the nose for each actuation of the tool, a magazine configured to house a collation including a plurality of the fasteners, and a workpiece contact element movably connected to the nose. The workpiece contact element is movable between a rest position and an actuated position. When the workpiece contact element is pressed against a workpiece, the workpiece contact element moves to the actuated position. A lockout mechanism is operatively associated with the workpiece contact element and the magazine, and is movable between a first position and a second position where the lockout mechanism is biased to the second position. In operation, the lockout mechanism is in contact with the collation in the first position when fasteners are in the magazine, and moves to the second position when a last one of the fasteners in the collation has been driven by the driver blade. Also, when the actuation lockout mechanism is in the second position, the lockout mechanism blocks the movement of the workpiece contact element to the actuated position.

In another embodiment, a fastener-driving tool is provided and includes a housing, a power source associated with the housing and including a reciprocating driver blade, a tool nose connected to the housing and configured for receiving the driver blade for driving fasteners fed into the nose for each actuation of the tool, a magazine configured to house a collation including a plurality of the fasteners and disposed for sequentially feeding fasteners to the nose, a workpiece contact element movably connected to the nose, the workpiece contact element being movable between a rest position and an actuated position, when the workpiece contact element is pressed against a workpiece, and a trigger movably connected to the housing and being movable between a rest position and an activated position. Actuation of the tool is enabled when the workpiece contact element is moved to the actuated position and the trigger is moved to the activated position. A lockout lever is pivotably connected to the housing and is movable between a first position and a second position, where the lockout lever is biased to the second position. In operation, the lever is in contact with the collation in the first position during each actuation of the tool and moves to the second position when a last one of the fasteners in the collation has been driven by the driver blade. Also, in the second position, the lever blocks movement of the workpiece contact element to the actuated position and thereby prevents subsequent actuations of the tool when the trigger is moved to the activated position.

DETAILED DESCRIPTION

Figure 1:
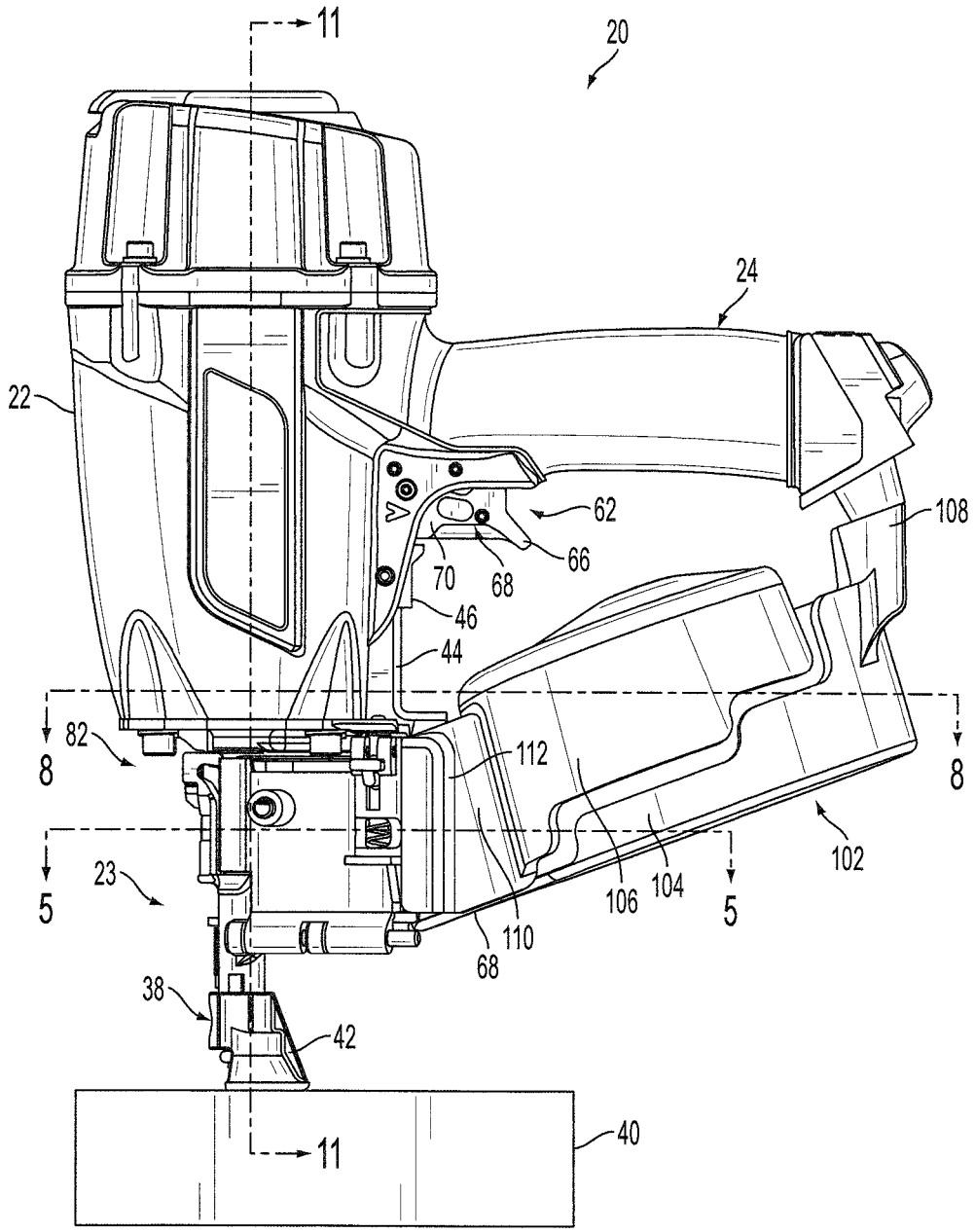
FIG. 1 is a perspective view of the present fastener driving tool including an actuation lockout mechanism.

Referring now to FIGS. 1-14, a fastener driving tool of the type suitable with the present actuation lockout mechanism is generally designated 20 and is depicted as a pnuematic-powered tool. The general principles of operation of such tools are known in the art, examples of which is described in U.S. Patent Application Publication No. 2012/0223120-A1, which is incorporated herein by reference. However, it is contemplated that the present actuation lockout mechanism is applicable to fastener driver tools powered by other power sources that employ a reciprocating driver blade for driving fasteners into a workpiece, such as electrically powered, combustion powered, or powder activated fastener driving tools.

Referring now to FIGS. 1-4, the pneumatic fastener driving tool 20 includes a housing 22 connected to a nose or nosepiece 23, the housing including a generally vertically extending head or forward portion and a rearwardly extending hollow handle 24 having a cavity defining a fluid reservoir 26. Pressurized fluid, such as compressed air, is supplied to the fluid reservoir 26 of the tool by a suitable flexible line (not shown). The drive system for the tool 20 includes a main or power cylinder 28 mounted within the head portion of the housing 22 and having an open upper end 30 that is configured to be selectively connected to the reservoir 26 as is known in the art (see FIGS. 2 and 3). A fastener driving assembly 32 is slidably and reciprocably mounted in the cylinder 28 and includes a main or drive piston 34 and a driver blade 36 connected to and depending from the piston.

To initiate an actuation of the tool, 20, a workpiece contact element 38 is initially pressed against a workpiece 40. More specifically, the workpiece contact element 38 includes a lower element 42 configured to be disposed on contact with the workpiece 40, and an upper linkage member 44 connected to the lower element and slidably mounted in a reciprocal manner in a channel 45 (FIG. 11) in the nosepiece 23. A guide member 46 is fixedly mounted upon the housing 22 to guide an upper free end distal portion 48 of the upper linkage member 44 during its movement with respect to the housing.

Figure 2:
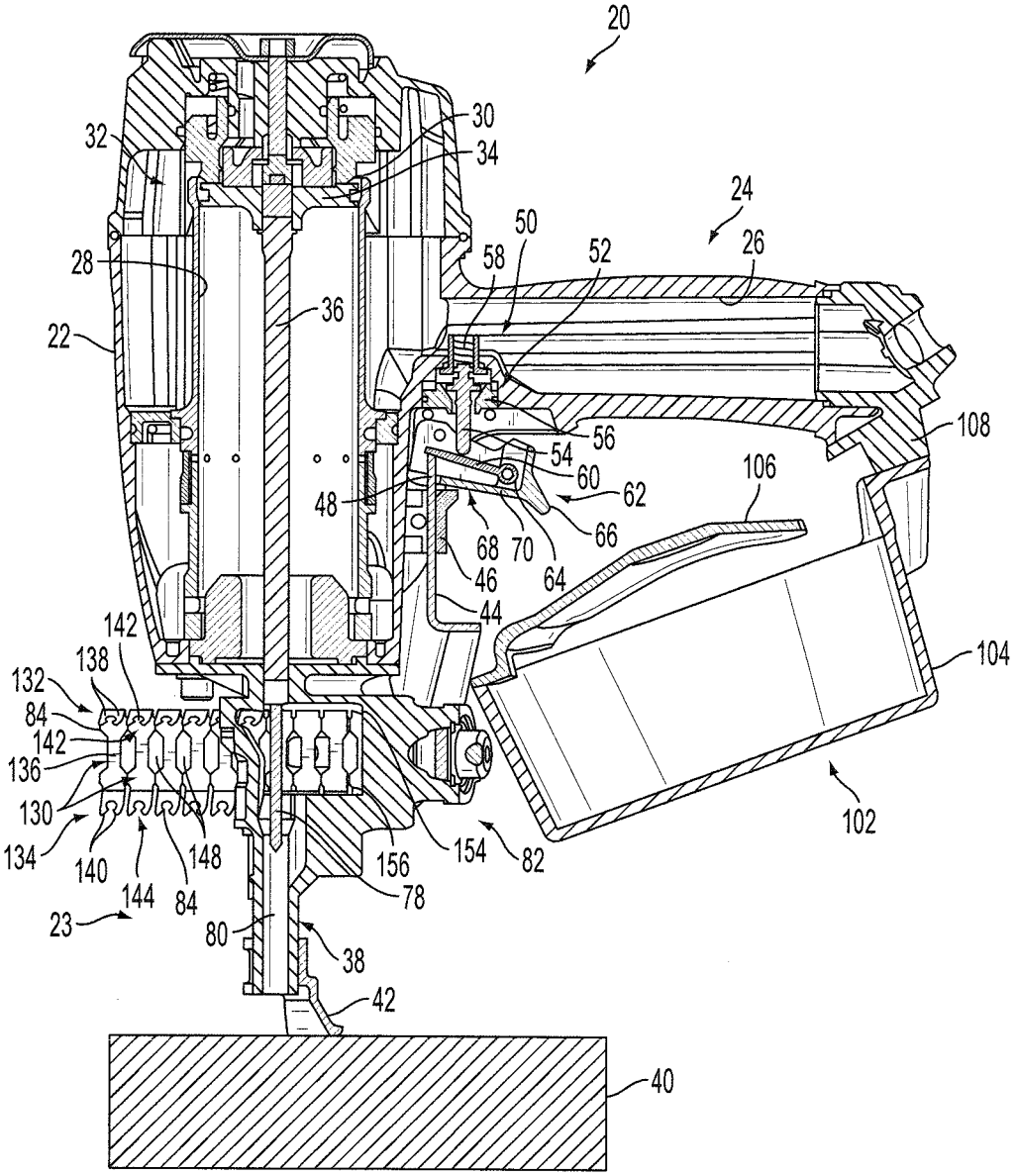
FIG. 2 is a vertical cross-sectional view of the fastener driving tool of FIG. 1, where the workpiece contact element has been depressed against a workpiece and the trigger has not been depressed or actuated.
Figure 3:
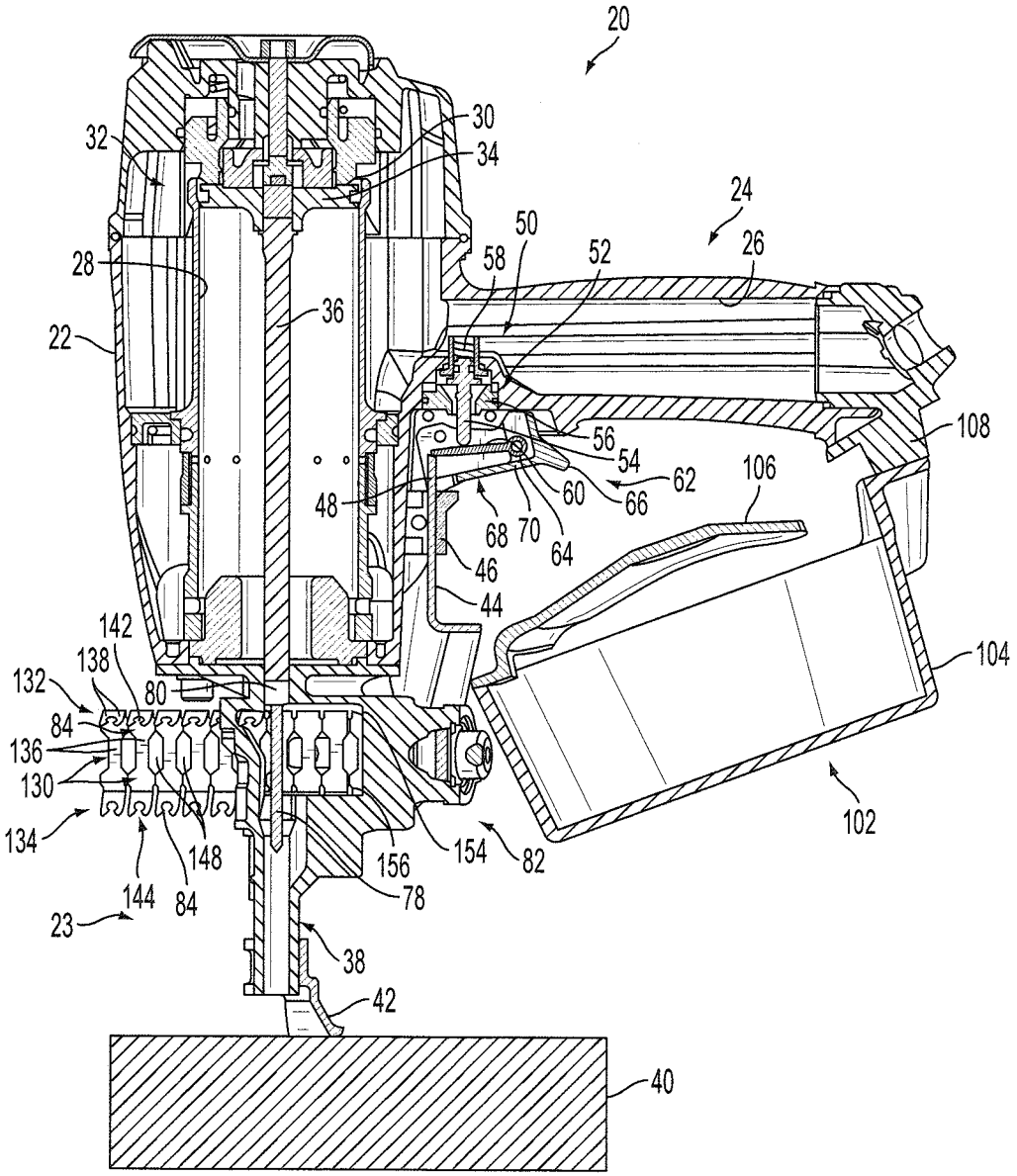
FIG. 3 is a cross-sectional view of the fastener driving tool of FIG. 1, where the workpiece contact element has been depressed against a workpiece and the trigger has been depressed or actuated by a user.

A control valve assembly 50 is mounted upon the tool housing 22 as is well known in the art to initiate actuation of the fastener-driving tool 20 when the control valve assembly is actuated as described below. As shown in FIGS. 2 and 3, the control valve assembly 50 includes a valve member 52 having a valve stem 54 that is seated upon a valve seat 56 and biased to a closed position by a spring 58. The valve stem 54 is configured to be engaged by an actuation lever 60 of a trigger assembly 62 to initiate actuation of the tool 20. Specifically, the actuation lever 60 is movably connected to the trigger assembly 62 and moves between a first position or rest position (FIG. 2) and a second position or activated position (FIG. 3). A bias member, such as coil spring 64, is preferably attached between the actuation lever 60 and the trigger assembly 62 and biases the actuation lever to the rest position.

Figure 4:
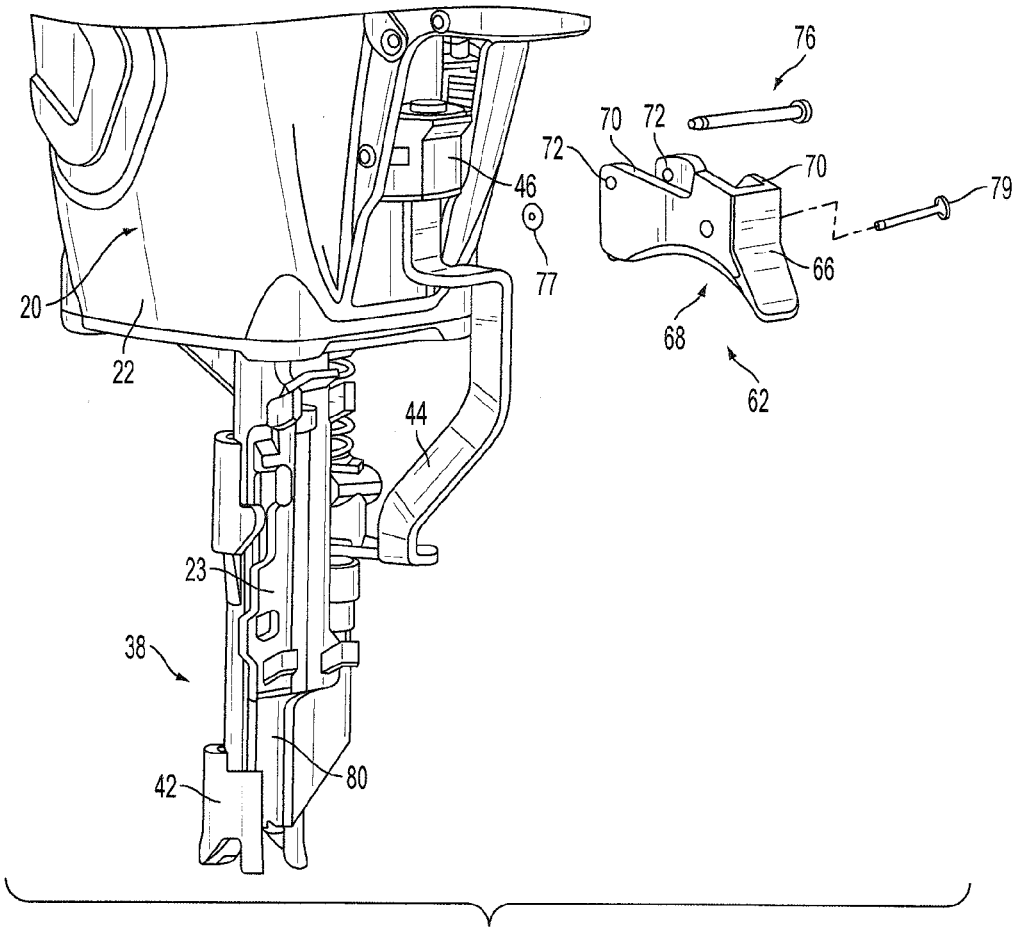
FIG. 4 is an enlarged, fragmentary view of the workpiece contact element assembly and the trigger assembly of the fastener driving tool of FIG. 1.

Referring now to FIGS. 2-4, the trigger assembly 62 includes a trigger 66 which has a hollow housing structure 68 with a pair of oppositely disposed side walls 70 (FIG. 4) for accommodating the actuation lever 60 and the coil spring 64. The sidewalls 70 have connecting holes 72 that are aligned with holes on the housing 22 and are joined by a trigger pivot pin 76 that is secured to the housing by a lock washer 77 for pivotably connecting the trigger 66 to the housing. The sidewalls 70 further include openings or holes 74 that are aligned with an opening on the actuation lever 60 and receive a lever pivot pin 79 for pivotably mounting the actuation lever to the trigger 66.

Upon actuation, as the trigger 66 causes opening of the control valve 52, the piston 34 and the driver blade 36 are driven through the cylinder 28 to drive a fastener 78 fed into a drive channel 80 in the nosepiece 23 by a feeder mechanism 82. The feeder mechanism 82 sequentially feeds fasteners 78, which are held in a fastener support such as collation 84, to the drive channel 80. Referring now to FIGS. 5, 6 and 8-10, the feeder mechanism 82 includes a cylindrical wall 90 configured to receive a conduit or tube (not shown) for providing compressed air to a feed cylinder 92. Specifically, the conduit diverts power source gas, i.e., pressurized air, from the drive cylinder 28, into the feed cylinder 92 and against a feed piston 96 to move the feed piston, an associated piston rod 98, and a feed pawl 100 from an advanced position (FIG. 5) to a retracted position (FIG. 6).

Referring now to FIGS. 1-3, the feeder mechanism 82 also includes a fastener magazine 102, which in the illustrated embodiment is a coil-type magazine, including a fixed portion 104 and a pivotable portion 106 as described in U.S. Pat. No. 8,276,798, which is incorporated herein by reference. It should be appreciated that the feeder mechanism may be any suitable feeder mechanism used with powered-fastener driving tools. The fixed portion 104 is fixed to the housing 22, typically the handle 24, via an arm 108. Further, an aim 110 (FIG. 1) pivotably connects the pivotable portion 106 to the fixed portion 104 where the arm 110 is hinged to the fixed portion via a hinge 112 or other suitable pivoting connector, and is pivotable between an opened position (not shown) for loading fasteners, and a closed position (see FIG. 1).

Figure 5:
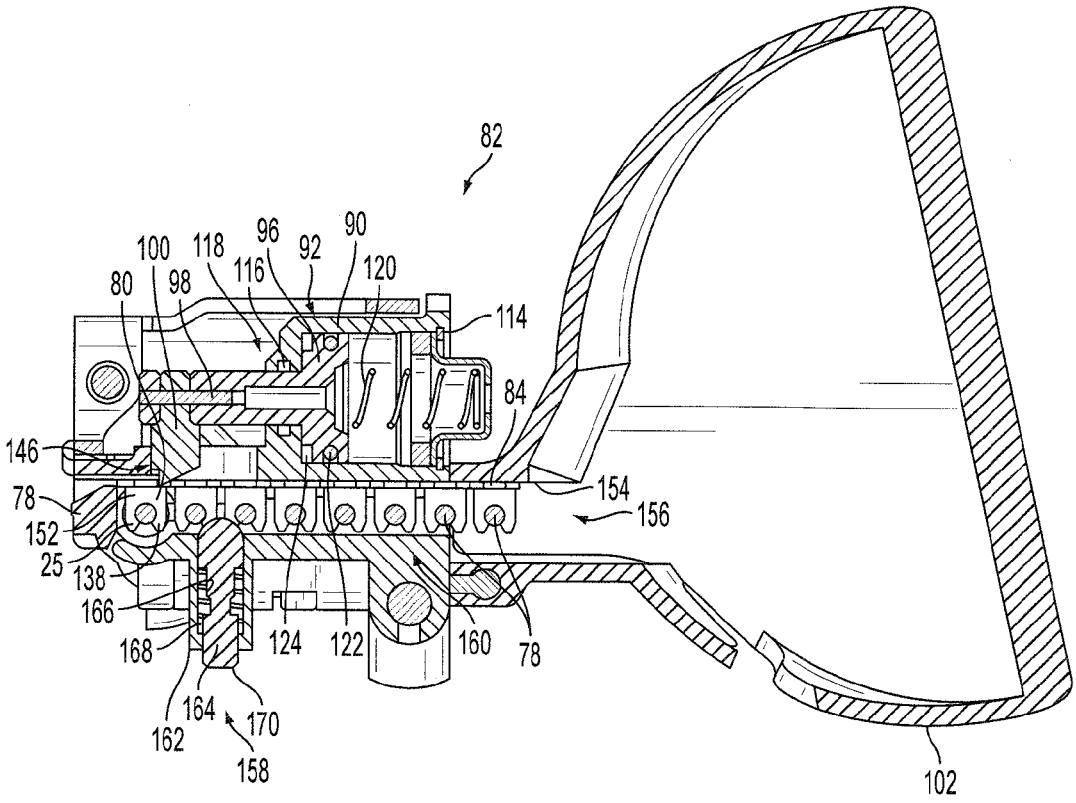
FIG. 5 is a cross-sectional view taken along the line 5-5 of FIG. 1 in the direction generally indicated, where the feed pawl is in an extended state for feeding a fastener into the drive channel of the nosepiece.
Figure 6:
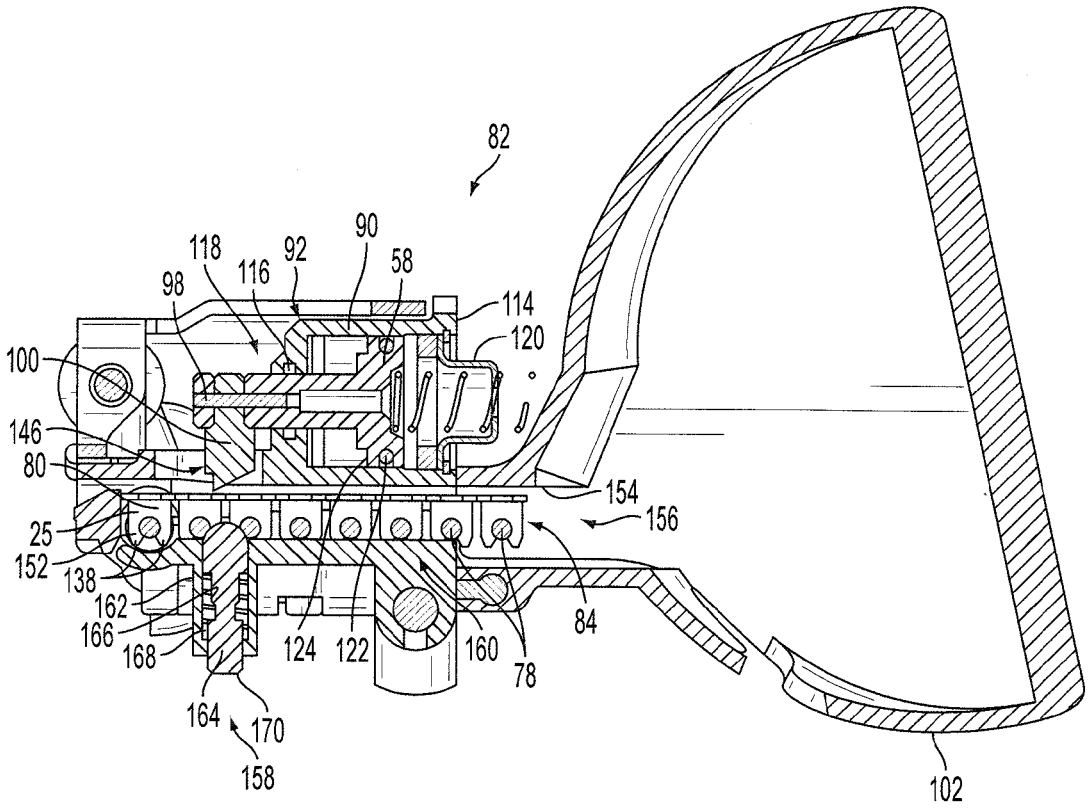
FIG. 6 is a cross-sectional view similar to FIG. 5 where the feed pawl is in a retracted state for indexing the collation in the feed track.

In FIGS. 1, 5 and 6, the feeder mechanism 82 includes the feed cylinder 92, which has the cylindrical wall 90, an end 114, and an annular O-ring 116 fixed within the cylindrical wall 90 at an outer, apertured end 118 of the feed cylinder. The feed piston 96 is movable within the cylindrical wall 90 between the retracted position (FIG. 6) and the advanced position (FIG. 5), and is provided with the piston rod 98. Sealed by the O-ring 116 and guided by the apertured end 118, the piston rod 98 moves commonly with the feed piston 96.

Inside the feed cylinder 92 is a return spring 120 which is seated against the end 114 as will be described in greater detail below, and which biases the feed piston 96 toward the advanced position (FIG. 5). An O-ring 122 is seated in a peripheral groove 124 of the feed piston 96 and seals against the cylindrical wall 90 as the feed piston 96 reciprocates within the feed cylinder 92. The feed pawl 100, which is mounted to the piston rod 98, is commonly movable with the piston rod 98 and the feed piston 96 between the retracted and advanced positions.

Referring to FIGS. 2, 3, 5 and 6, the fasteners 78 are pre-mounted individually in fastener compartments 130 of the collation 84 having upper tabs 132 and lower tabs 134 that are movably or hingedly connected to an elongated support wall 136. Both the upper and lower tabs 132, 134 are movable between a ([-shaped) support position, in which the upper and lower tabs extend transversely from the support wall 136, and a release position in which at least one of the upper and lower tabs are generally aligned with the support wall 136.

As shown in FIG. 2, each of the upper and lower tabs 132, 134 respectively include pairs of upper and lower arms 138 and 140 where each of the pairs of upper and lower arms define upper and lower fastener slots 142 and 144 therebetween. Specifically, the upper fastener slots 142 defined between the upper arms 138 and the lower fastener slots 144 defined between the lower arms 140 are aligned with each other along a longitudinal axis so that the fasteners 78 can be readily inserted, mounted in, and restrained by the aligned upper and lower fastener slots.

In the illustrated embodiment, the fasteners 78 are mounted in the coil-type collation 84 that includes a plurality of fasteners to be fed into the drive channel 80 of the tool 20. As described below, after each actuation of the tool 20, the feed pawl 100 of the feeder mechanism 82 sequentially indexes the collation 84 until the nearest lower tab 134 of the next fastener compartment 130 contacts an inner, vertical surface 25 (FIGS. 5 and 6) of the nosepiece 23 to stop further movement of the collation. When the fastener 78 in the fastener compartment 130 is driven through the nosepiece 23, the lower tabs 134 of the fastener compartment 130 are pushed downwardly by the fastener 78 and moved to the release position (see FIGS. 2 and 3). This allows the empty fastener compartment to pass through a drive slot 27 (FIG. 8) in the nosepiece 23 to index the collation to the next fastener compartment 130 as described above.

More specifically, the feed pawl 100 has a protruding end 146 (FIG. 5), which is configured for engaging a groove 148 (FIG. 3) defined between adjacent fastener compartments 130 in the collation 84 when the feed pawl is in the operative position and for advancing the collation when the feed piston 96, the piston rod 98, and the feed pawl 100 are moved by spring pressure from the retracted position (FIG. 6) to the advanced position (FIG. 5). To allow the feed pawl 100 to move or slide over an outer surface 150 (FIGS. 8 and 9) of the collation 84, the end 146 of the feed pawl includes an angled camming surface 152 configured for camming or sliding over the outer surface 150 of the collation 84 to the next groove 148 when the feed pawl 100 moves from the advanced position to the retracted position.

The collation 84 should remain generally in contact with an inner wall 154 of the feed track 156 of the magazine 102 as shown in FIG. 5 so that the feed pawl 100 can engage the grooves 148 and sequence or index the collation. Thus, a fastener tensioning mechanism such as backup pawl 158 is mounted on an opposing side 160 of the collation 84 from the feeder mechanism 82. The backup pawl 158 includes a housing 162 and a tensioning post 164 movably connected to the housing 162 where the post is movable between an extended position and a retracted position.

As shown in FIGS. 5 and 6, the tensioning post 164 includes an annular groove 166 and a spring 168 positioned in the groove 166 for biasing the post to the extended position. An outer end 170 of the post 164 has a rounded shape and is configured for engaging adjacent upper arms 138 of the fastener compartments 130 in the collation 84 to apply pressure to the arms 138 and press a rear surface 172 (FIG. 8) of the support wall 136 of the collation against the inner wall 154 of the feed track 156 of the magazine 102 to maintain sufficient contact between the collation 84 and the feed pawl 100.

As is the case with conventional fastener driving tools, the present tool 20 is actuated by initially pressing the workpiece contact element 38 against the workpiece 40, such as a sheet of drywall, which causes the workpiece contact element to move upwardly along the nosepiece 23 and contact and move the actuation lever 60 in the trigger 66 to the actuated position. In a sequential mode of operation, the trigger 66 is depressed i.e., moved from the rest position to the actuated position, causing the actuation lever 60 to move or pivot and contact and move the valve stem 54 to the activated position. When the valve stem 54 moves to the activated position, the tool 20 is activated, and a designated amount of the compressed fluid (pressurized air) from the reservoir 26 enters the upper end of the housing 22 and pushes against the cylinder 28 to drive the fastener driving assembly, and more specifically, the piston 34 and the driver blade 36 downwardly through the cylinder and into engagement with a fastener 78 in the drive track or drive channel 80 of the nosepiece 23. After the actuation of the tool 20, the piston 34 returns to the top of the cylinder 28 and the feeder mechanism 82 feeds the next fastener into the drive track 80 and the above steps are repeated. In an alternative repetitive mode of operation, the operator maintains the trigger in the actuated position, and fasteners are driven each time the workpiece contact element 38 contacts the workpiece.

In the field, a tool operator typically drives fasteners into a workpiece at a rapid pace to quickly secure the workpiece, such as a drywall sheet, in position on an underlying frame. The operator therefore continues to actuate the powered fastener tool and drive fasteners into the drywall sheet until there are no fasteners remaining in the magazine. Because it is too time consuming to constantly check the fastener magazine to see how many fasteners remain in the magazine, the operator typically initially discovers that the magazine is empty when they actuate the tool without any fasteners remaining in the magazine, commonly known as "dry-firing" or "mis-firing" the tool. As a result, a fastener is not driven into the drywall sheet. Because heads of fasteners driven into drywall sheets are recessed from the outer surface of the drywall sheet so that the fasteners can be sufficiently covered with a drywall patching joint compound, the driver blade is configured to extend past the end of the nosepiece of to tool to recess the fasteners. Thus, when the magazine is empty and the operator dry-fires the tool, the tool still drivers the driver blade through the drive track and into the drywall sheet thereby forming a hole and damaging the drywall sheet.

Referring now to FIGS. 7A-7G and 8-14, to overcome this problem, the present tool 20 includes an actuation lock-out mechanism 176 that is positioned adjacent to the magazine 102, is associated with the workpiece contact element 38 and the magazine 102, and is movably connected to the nosepiece 23. The actuation lock-out mechanism 176 includes a generally planar lever 178 including a first end 180 and an opposing second end 182. The first end 178 includes a first post 184 that is integrally formed with the lever 178 and protrudes from a side of the lever. The second end 182 includes a second post 186 and a stop arm 188, where the second post extends from a common side of the lever as the first post 184, and the stop arm 188 extends transversely from the second post 186. Also, the posts 184, 186 extend along parallel axes. In between the first post 184 and the second post 186 is a through-hole 190 configured to receive a pivot pin 192 that is inserted through the through-hole and secured in a pair of spaced ears (not shown) each having a corresponding opening 194 in the nosepiece 23. The lever 178 moves or pivots about the pivot pin 192 as best shown in FIGS. 8 and 13.

A bias member such as coil spring 196 (FIG. 9) is positioned between the nosepiece 23 and the first post 184 to bias the lever 178 from a first, collating position to a second, blocking position. As shown in FIG. 10, the coil spring 196 has a size and shape that corresponds to the size and shape of the first post 184 such that the first post is inserted at least partially into a central through-hole 198 defined by the coil spring 196 to seat the spring in place.

Figure 7A:
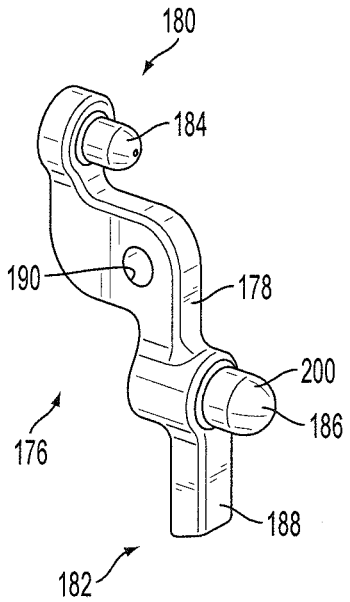
FIG. 7A is a perspective view of the lever of the present actuation lockout mechanism.
Figure 7B:
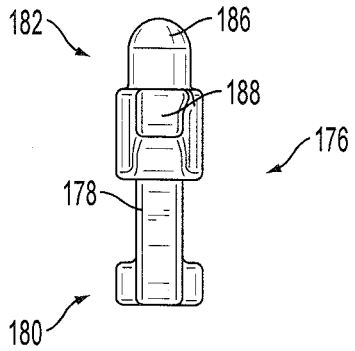
FIG. 7B is a bottom view of the lever of the actuation lockout mechanism of FIG. 7A.
Figure 7C:
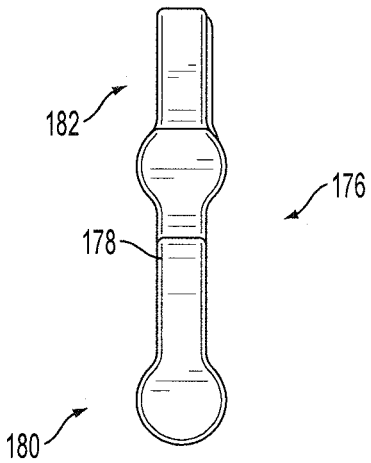
FIG. 7C is a rear view of the lever of the actuation lockout mechanism of FIG. 7A.
Figure 7D:
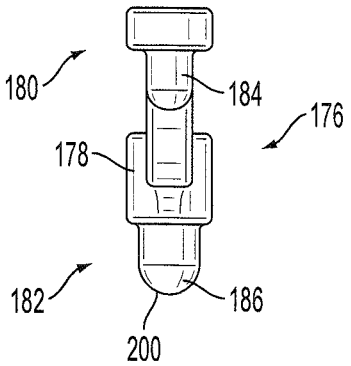
FIG. 7D is a top view of the lever of the actuation lockout mechanism of FIG. 7A.
Figure 7E:
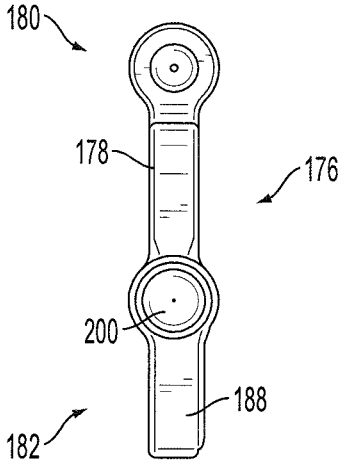
FIG. 7E is a front view of the lever of the actuation lockout mechanism of FIG. 7A.
Figure 7F:
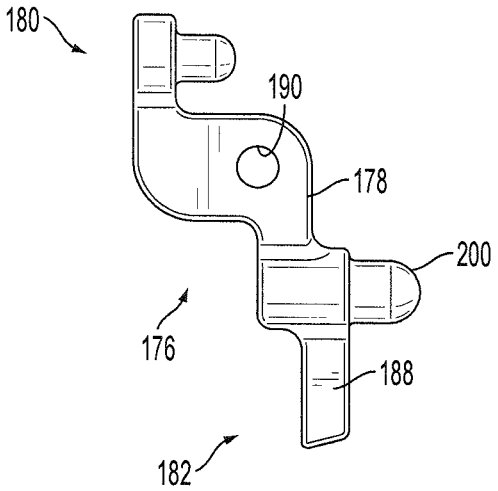
FIG. 7F is a left side view of the lever of the actuation lockout mechanism of FIG. 7A.
Figure 7G:
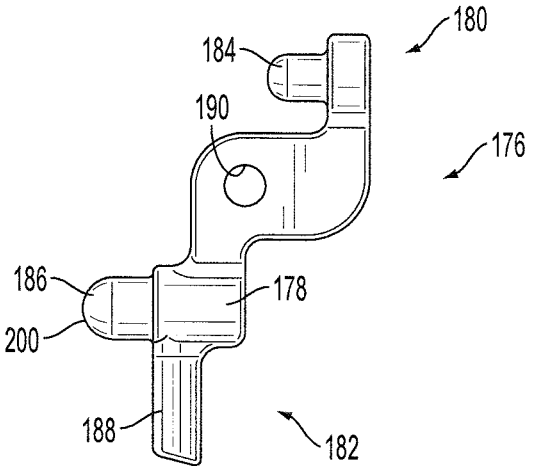
FIG. 7G is a right side view of the lever of the actuation lockout mechanism of FIG. 7A.
Figure 8:
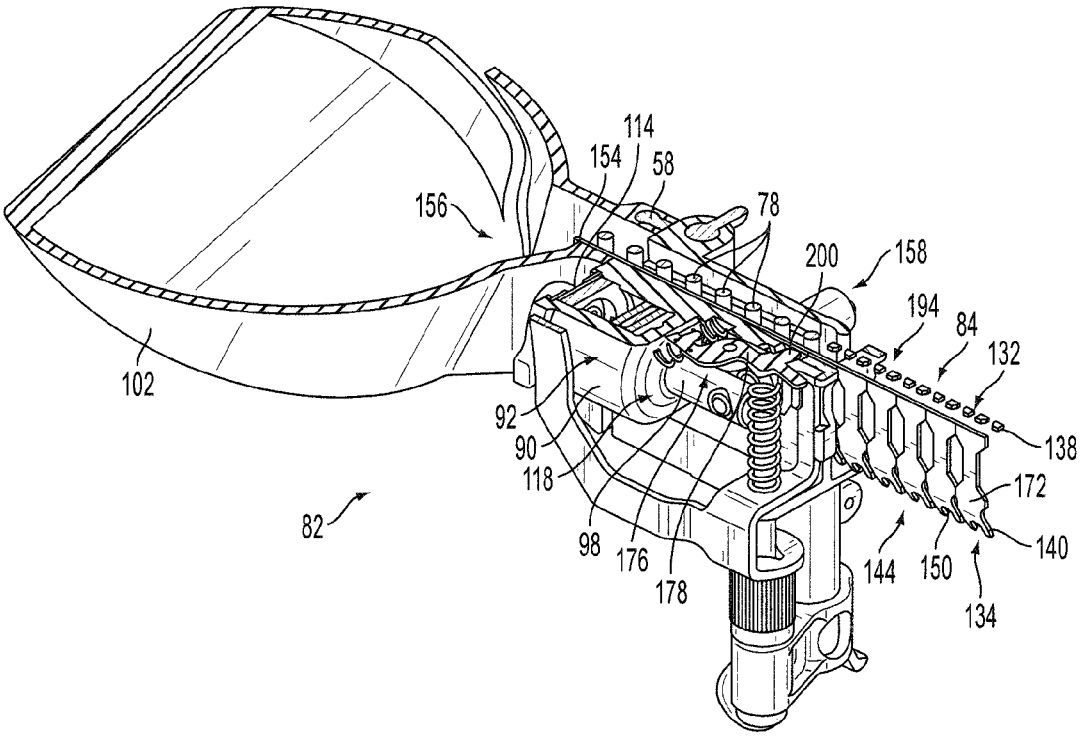
FIG. 8 is a perspective cross-sectional view taken along the line 8-8 of FIG. 1.
Figure 9:
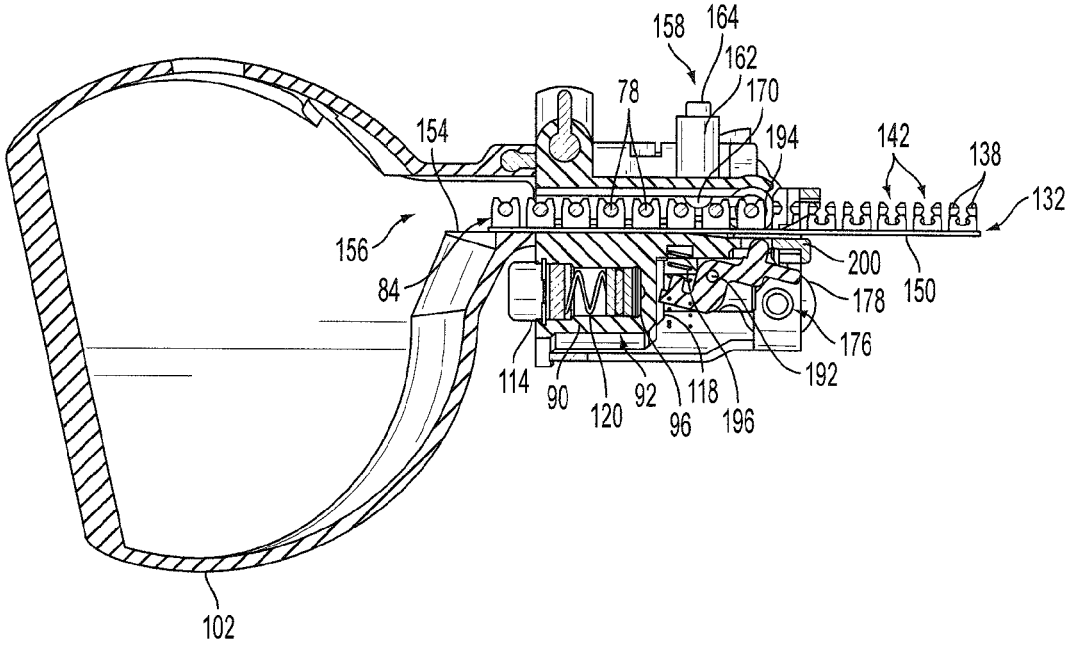
FIG. 9 is a top cross-sectional view of the feeder mechanism of FIG. 8 where the collation includes a plurality of fasteners.
Figure 10:
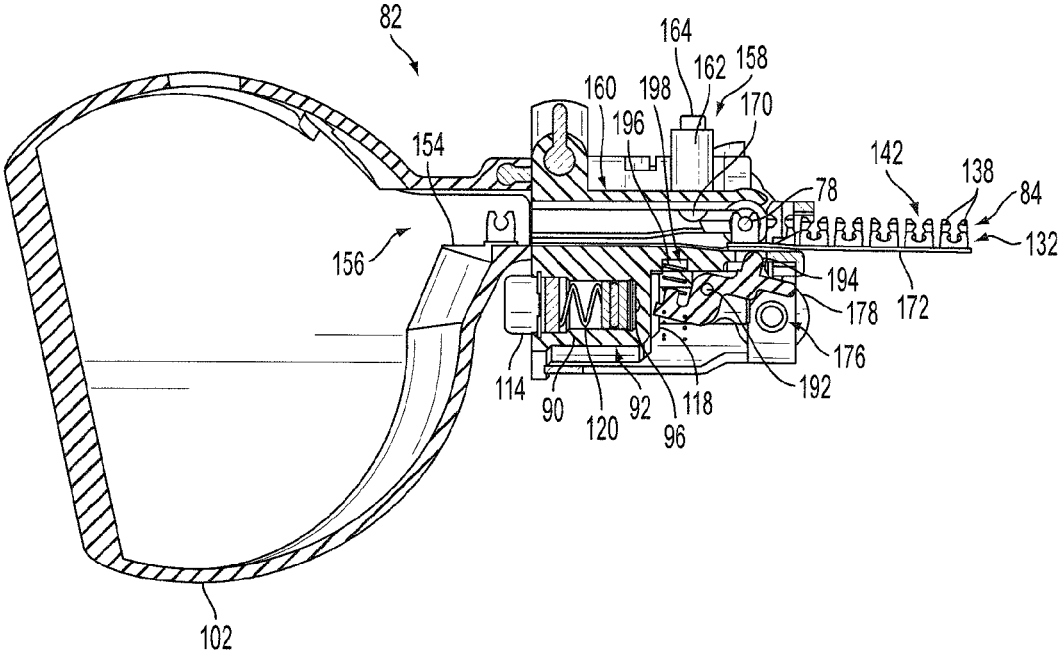
FIG. 10 is a top cross-sectional view of the feeder mechanism of FIG. 8, where there is only one fastener remaining in the collation.
Figure 11:
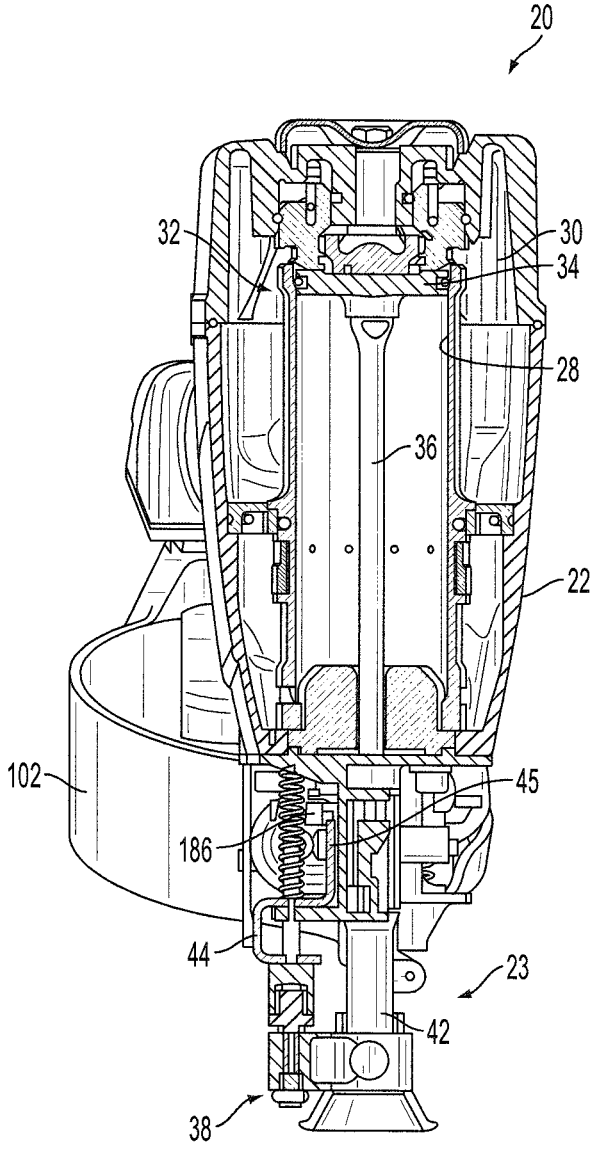
FIG. 11 is a front cross-section taken along the line 11-11 of FIG. 1 and in the direction generally indicated, where the present actuation lockout mechanism is in a not in the lock out position.
Figure 12:
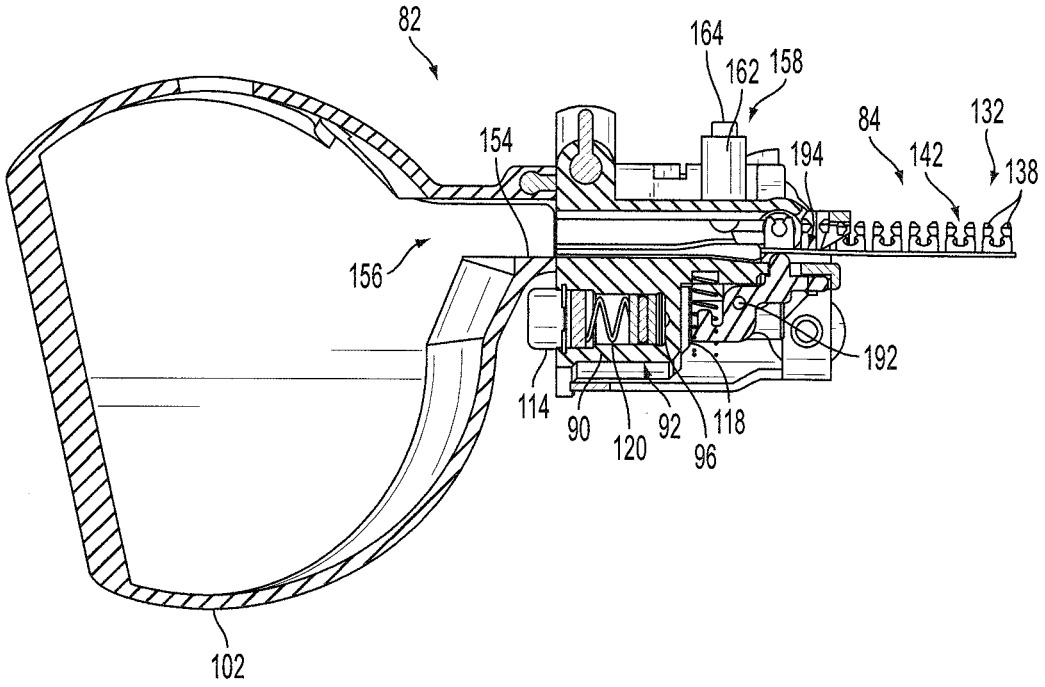
FIG. 12 is a top cross-sectional view of the feeder mechanism of FIG. 8 where there are no fasteners remaining in the collation.

Referring now to FIGS. 7F and 9, and the second post 186 has a generally rounded outer, camming surface 200 that extends through a corresponding opening 194 in the nosepiece 23 and contacts the outer surface 150 of the collation 84. During the indexing of the collation 84, the second post 186 moves or slides along the outer surface 150 of the collation until the last fastener compartment 130 passes the opening 202. At this point, the backup pawl 158 no longer engages the collation 84 to hold it against the inner wall 174 of the magazine 102. Thus, the force of the coil spring 196 on the first end 180 of the lever 178 overcomes the negligible force of the collation 84 against the second post 186. At this point, the collation 84 is not tensioned and therefore falls away from the tool, and the lever 178 is now able to move or pivot from the collating position to the blocking position and causes the second post 186 to move through the opening 194 and into the magazine 102 as shown in FIGS. 12-14.

Figure 13:
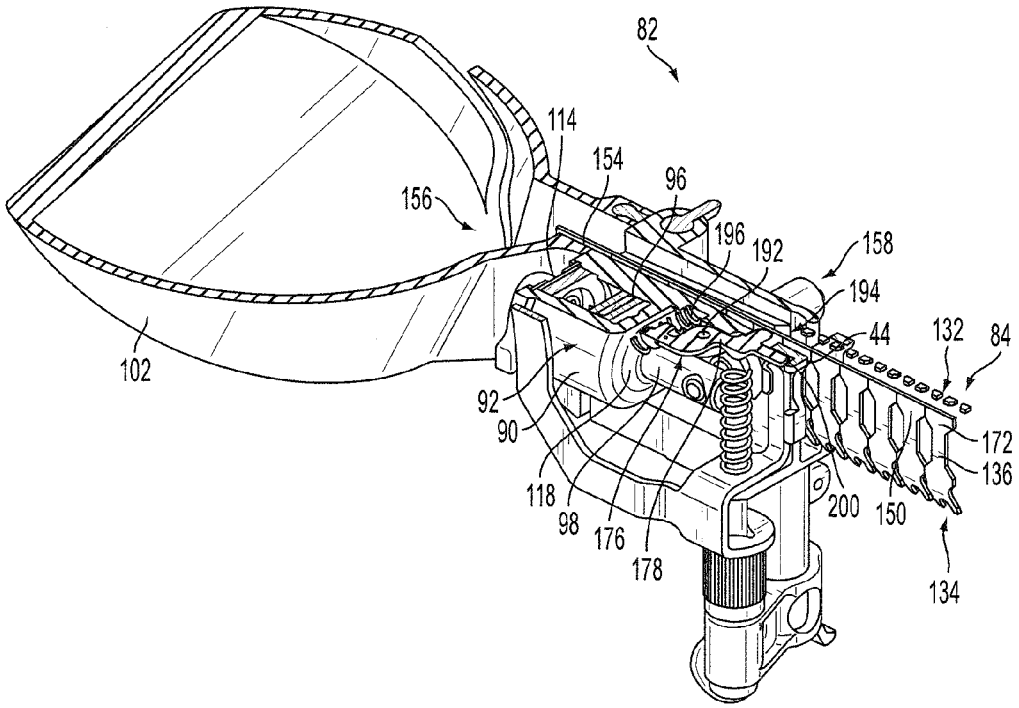
FIG. 13 is a top perspective cross-sectional view of the feeder mechanism of FIG. 12.
Figure 14:
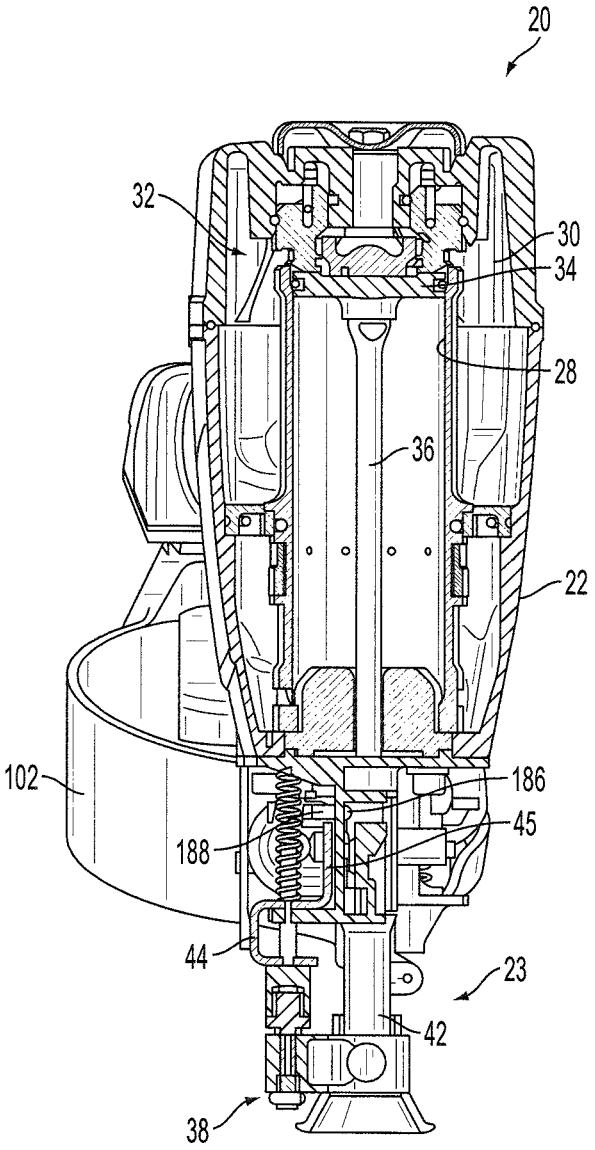
FIG. 14 is a front cross-section taken along the line 11-11 of FIG. 1 and in the direction generally indicated, where the present actuation lockout mechanism is in the lock out position.

Referring now to FIGS. 13 and 14, the movement of the lever 178 from the collating position to the blocking position simultaneously moves the stop arm 188 into the channel 45 (FIG. 14) through which a linkage portion of the workpiece contact element 38 moves relative to the housing 22. Once it extends into the channel, the stop arm 188 now blocks or stops the upward movement of the workpiece contact element 38 when it is pressed against the workpiece 40. As a result, the workpiece contact element 38 cannot contact the actuation lever 60 as described above to move the actuation lever into a position to engage the valve stem 54 when the trigger 66 is depressed, thereby preventing actuation of the tool 20 when no fasteners 78 remain in the magazine 102. Subsequently, the tool 20 will not actuate and drive a fastener 78 until another fastener collation 84 is loaded into the magazine 102, regardless of the number of times that the operator depresses or activates the trigger 66.

To enable actuation of the tool 20 after the magazine 102 is empty, i.e., the fasteners 78 in the collation 84 are used up, the operator loads another collation 84 having fasteners 78 into the magazine 102 so that the front end of the collation contacts the camming surface 200 of the second post 186 and pushes the second post inwardly against the force of the spring 196 to the collating position as shown in FIGS. 8 and 9. The operator may now use the fastener driving tool 20 again as described above to drive fasteners 78 into workpieces such as the drywall sheet until there are no fasteners remaining in the collation 84.

While a particular embodiment of the present actuation lockout mechanism for a powered fastener-driving tool has been described herein, it will be appreciated by those skilled in the art that changes and modifications may be made thereto without departing from the invention in its broader aspects and as set forth in the following claims.

What is claimed is:

1. A fastener-driving tool comprising:

a housing;

a power source associated with said housing and including a reciprocating driver blade;

a tool nose connected to said housing and configured for receiving said driver blade for driving a fastener fed into said nose for each actuation of the tool;

a magazine configured to house a collation including a plurality of the fasteners;

a workpiece contact element movably connected to said tool nose, said workpiece contact element being movable from a rest position to an actuated position upon engagement against a workpiece; and a lockout mechanism operatively associated with the workpiece contact element and the magazine and movable between a first position and a second position, said lockout mechanism including a side adjacent to said collation, a first post and a second post extending from said side, and a blocking member extending transversely from said second post, said first post contacting a biasing member configured to bias said first post away from the collation, said second post toward the collation, and said lockout mechanism to said second position, wherein said second post of said lockout mechanism is in contact with the collation when said lockout mechanism is in said first position when fasteners are in the magazine, and moves into said magazine when said lockout mechanism moves to said second position when a last one of the fasteners in the collation has been driven by said driver blade, and wherein in said second position, said blocking member blocks said workpiece contact element to prevent said workpiece contact element from moving to said actuated position.

2. The tool of claim 1, further comprising a feeder mechanism movably connected to said housing and positioned on a first side of the collation, said feeder mechanism being configured for sequentially feeding each of said fasteners into said nose.

3. The tool of claim 2, wherein said feeder mechanism includes a feed pawl and a reciprocating feed cylinder connected to said feed pawl, said feed cylinder causing said feed pawl to move between a retracted position and an advanced position.

4. The tool of claim 2, further comprising a backup mechanism movably connected to said housing and positioned on an opposing second side of said collation, said backup mechanism being biased against the collation.

5. The tool of claim 1, wherein said lockout mechanism includes a lever pivotably connected to said housing and including a first end and a second end, said first end having said first post and said second end having said second post and said blocking member.

6. The tool of claim 5, wherein said biasing member is a spring positioned between said first post and said tool nose for biasing said lockout mechanism to said second position.

7. The tool of claim 1, wherein said magazine is a coil magazine.

8. A fastener-driving tool comprising:

a housing;

a power source associated with said housing and including a reciprocating driver blade;

a tool nose connected to said housing and configured for receiving said driver blade for driving a fastener fed into said nose for each actuation of the tool;

a magazine configured to house a collation including a plurality of the fasteners and disposed for sequentially feeding fasteners to the nose;

a workpiece contact element movably connected to said tool nose, said workpiece contact element being movable from a rest position to an actuated position when said workpiece contact element is pressed against a workpiece;

a trigger movably connected to said housing and movable between a rest position and an activated position, wherein actuation of the tool occurs when said workpiece contact element is moved to said actuated position and said trigger is moved to said activated position; and a lockout lever pivotably connected to said nose and movable between a first position and a second position, said lockout lever including a side adjacent to said collation, a first post and a second post parallel to each other and extending from said side, and a blocking member extending transversely from said second post, said first post contacting a biasing member configured to bias said first post away from the collation, said second post toward the collation, and said lever to said second position, wherein said second post of said lever is in contact with the collation when said lever is in said first position, and moves into said magazine when said lever moves to said second position when a last one of the fasteners in the collation has been driven by said driver blade, and wherein in said second position, said blocking member blocks movement of said workpiece contact element to said actuated position and thereby prevents subsequent actuations of the tool when said trigger is moved to said activated position.

9. The tool of claim 8, further comprising an actuation lever movably connected to said trigger and positioned adjacent to an end of said workpiece contact element, said actuation lever being movable from a rest position to an activated position when said workpiece contact element contacts said actuation lever upon depression of said workpiece contact element on said workpiece.

10. The tool of claim 9, further comprising a control valve including an actuating pin, said actuating pin being activated when said actuation lever moves to said activated position and engages said actuating pin in each actuation of the tool.

11. The tool of claim 8, further comprising a feeder mechanism movably connected to said nose and positioned on a first side of said collation, said feeder mechanism being configured for sequentially feeding each of said fasteners into said nose.

12. The tool of claim 11, wherein said feeder mechanism includes a feed pawl and a reciprocating feed cylinder connected to said feed pawl, said feed cylinder causing said feed pawl to move between a retracted position and an advanced position.

13. The tool of claim 11, further comprising a backup mechanism movably connected to said nose and positioned on an opposing second side of said collation, said backup mechanism being biased against said collation.

14. The tool of claim 8, wherein said lockout lever is pivotably connected to said nose and includes a first end and a second end, said first end having said first post and said second end having said second post and said blocking member.

15. The tool of claim 14, wherein said biasing member is a spring positioned between said first post and said housing for biasing said lever to said second position.

16. The tool of claim 8, wherein said magazine is a coil magazine.

17. The tool of claim 8, wherein said second post includes a camming surface configured to slide on a surface of the collation.

* * * * *